US006286594B1

(12) United States Patent
French

(10) Patent No.: US 6,286,594 B1
(45) Date of Patent: Sep. 11, 2001

(54) DOWNHOLE VALVE

(75) Inventor: Clive John French, Aberdeen (GB)

(73) Assignee: OCRE (Scotland) Limited (GB)

( * ) Notice: Subject to any disclaimer, the term of this patent is extended or adjusted under 35 U.S.C. 154(b) by 0 days.

(21) Appl. No.: 09/319,562

(22) PCT Filed: Oct. 9, 1998

(86) PCT No.: PCT/GB98/03045

§ 371 Date: Oct. 14, 1999

§ 102(e) Date: Oct. 14, 1999

(87) PCT Pub. No.: WO99/19602

PCT Pub. Date: Apr. 22, 1999

(30) Foreign Application Priority Data

Oct. 9, 1997 (GB) ..... 9721496

(51) Int. Cl.[7] ..... E21B 34/10
(52) U.S. Cl. ..... 166/151; 166/334.4
(58) Field of Search ..... 166/151, 321, 166/332.1, 334.4, 142

(56) References Cited

U.S. PATENT DOCUMENTS

| | | | | |
|---|---|---|---|---|
| 4,434,854 | * | 3/1984 | Vann et al. | 166/386 |
| 4,440,230 | * | 4/1984 | McGill | 166/321 |
| 5,170,844 | * | 12/1992 | George et al. | 166/319 |
| 5,305,828 | * | 4/1994 | White et al. | 166/151 |
| 6,152,224 | * | 11/2000 | French | 166/151 |

* cited by examiner

*Primary Examiner*—William Neuder
(74) *Attorney, Agent, or Firm*—Gifford, Krass, Groh, Sprinkle, Anderson & Citkowski, P.C.

(57) ABSTRACT

Downhole apparatus (10) for mounting on a string (12) for location in a drilled hole is provided, the apparatus comprising: a tubular body (14) defining a bore; a packer (16) mounted on the body (14) for sealing the annulus between the body (14) and the wall of the hole; a plug or valve (18) for closing the body bore (14) below the packer (16); a fluid actuated valve (20) in the body between the bore closing valve (18) and the packer (16) for permitting selective fluid communication between the body bore and the exterior of the body, and an arrangement (22) for transferring fluid pressure from above the packer (16) to the valve (20), whereby fluid pressure applied to the annulus above the packer (16) may be used to operate the valve (20).

24 Claims, 4 Drawing Sheets

DOWNHOLE VALVE

This invention relates to a downhole valve for mounting on a string, and in particular to a downhole valve for location below a packer.

In oil and gas exploration and production operations bores are drilled to gain access to subsurface hydrocarbon-bearing formations or reservoirs. The bores are lined with steel tubing, known as casing or liner, set in concrete, which liner is perforated at selected locations where the bore intersects the hydrocarbon-bearing formation. Testing and analysis of the formation, and also production of fluid from the formation, is normally achieved by utilising a tubular string which extends from the surface, through the lined bore, to the perforated section of bore which intersects the formation. The string is formed from a large number of tubing lengths which are threaded together and a packer is mounted on the lower end of the string to provide a seal between the exterior of the string and the bore wall and thus isolate the formation from the annulus above the packer. By providing a valve at the lower end of the string it is then possible to control access to the formation through the string. However, particularly during initial production operations, fluid flowing through the valve may be carrying sand, gravel, drill cuttings and other debris, and on closing such a valve there may be difficulties in obtaining an effective seal due to the accumulation of debris on the valve seals, or from erosion of the seals. Further, actuation of such valves will often require manual intervention, which is time consuming and expensive. It would be possible to utilise tubing pressure to open such valves, however this requires provision of controls or mechanisms to ensure that the valve will not open inadvertently when the tubing experiences elevated pressures, for example during completion testing. Further, it is not possible to close such a valve utilising tubing pressure without exposing the formation to elevated pressures, which is considered undesirable in most circumstances.

It is among the objectives of embodiments of the present invention to obviate or mitigate these disadvantages.

According to the present invention there is provided downhole apparatus for mounting on a string for location in a drilled bore, the apparatus comprising a tubular body defining a bore, a packer mounted on the body for sealing the annulus between the body and the wall of the bore, means for closing the body bore below the packer, a fluid actuated valve in the body between the closing means and the packer for permitting selective fluid communication between the body bore and the exterior of the body, and means for transferring fluid pressure from above the packer to the valve, whereby fluid pressure applied to the annulus above the packer may be utilised to operate the valve.

According to another aspect of the present invention there is provided a valve for mounting on a downhole string below a packer and for providing selective fluid communication between the tubing and an annulus, the valve being fluid actuated and adapted for communication with a fluid line extending from above a packer to the valve, whereby fluid pressure applied to the annulus above the packer may be utilised to operate the valve.

As the valve is located below the packer, the presence of the valve does not affect the completion or pressure integrity of the string in the event of valve leakage or failure.

The valve may be used as a downhole shut-in-tool for conducting build-up and reservoir analysis, or as a deep-set safety valve. Further, the valve may be used for flowing a well after a completion has been run and then isolating the reservoir until the well is ready to produce; for production, the closing means may be removed or opened to provide full-bore access to the reservoir.

Preferably, the valve is normally closed, such that, for example, in the event of a system failure the valve will close or remain closed.

Preferably also, the valve is full bore, that is, at least in the open position, it does not create a significant restriction in the body bore; the valve does not therefore restrict the flow of fluid from the reservoir to the surface and does not impede access to the reservoir through the string.

Preferably also, the valve comprises a sleeve. Most preferably, the sleeve is axially moveable relative to the body. In a preferred embodiment the sleeve defines one or more ports which may be selectively aligned with corresponding ports in the body. The sleeve is preferably mounted on the exterior of the body.

The use of a sleeve avoids many of the difficulties experienced by existing arrangements where it is desired to open and close a valve providing fluid communication between tubing and the bore below a packer; such existing arrangements utilise ball or flapper valves, and while the valves remain open there is a likelihood that debris will collect on the valve seat, or erode the valve seat, such that it may be difficult to achieve a seal when the valve is closed.

Preferably also, the means transferring fluid pressure from above the packer to the valve includes a piston having one face for communication with fluid above the packer and the other face in communication with a volume of fluid in a fluid line. Most preferably, said volume of fluid communicates with a piston face defined by the valve, via the fluid line.

Preferably also, the valve is biassed to a closed position, preferably by one or both of fluid pressure and spring force. Where a fluid pressure biassing force is utilised, a chamber may be defined between the valve and the body for containing the fluid. The chamber may accommodate a spring. The chamber may be filled with pressurised fluid on surface to provide a desired spring force. However, it is preferred that the fluid is pressurised at the operating depth of the apparatus. This may be achieved by providing the chamber with a moveable wall in fluid communication with the body bore or body exterior such that the wall experiences at least hydrostatic pressure and will thus move into the chamber to pressurise the fluid in the chamber to at least hydrostatic pressure. Most preferably, the wall is adapted to be selectively exposed to the body bore or exterior; this permits the fluid spring to be pressurised to a predetermined level by exposing the wall to pressure at a selected interval, and then isolated once more to avoid the wall being exposed to elevated pressures, for example during completion testing. Conveniently, the apparatus may be provided in conjunction with apparatus for providing selective fluid communication between the body bore and a valve as described in W097/05759 or W097/06344, the disclosures of which are incorporated herein by reference. The wall preferably includes means for conserving movement, such as a ratchet.

Where a spring biassing force is utilised to close the valve, the rate or precompression of the spring may be selected for compatibility with the fluid pressure experienced at the depth where the apparatus is expected to operate; at greater depths the actuating pressure will be higher than at lesser depths. Alternatively, or in addition, the valve may include means which may be configured to vary the valve opening force provided by a given pressure. In the preferred embodiment this is achieved by providing a plurality of valve actuating pistons which may be configured for communication with the fluid line. A face of each piston is preferably in communication with a low pressure volume, for example an atmospheric chamber. The number of pistons in communication with the fluid line may be selected such that the force necessary to overcome the spring and open the valve is produced by a predetermined overpressure in the annulus. The fluid line may define a plurality of branches, one leading to each piston. A connector may be provided in each branch, one form of connector providing fluid communication therethrough and another forming a plug or barrier. The pistons may be defined by shuttles, one end of each shuttle bearing on or otherwise coupled to a valve member.

The closing means may be in the form of a plug or valve, and most preferably is a disc valve as described in W097/28349, the disclosure of which is incorporated herein by reference; when it is desired to provide full-bore access to a reservoir the disc valve may be opened.

According to another aspect of the present invention there is provided a downhole actuation arrangement for a fluid actuated tool, the arrangement comprising:

a body;

a plurality of cylinders, each containing a piston operatively associated with the tool;

a plurality of fluid lines, each line for providing communication between a pressure source and a respective cylinder; and means for selectively closing one or more of said lines;

the actuating force applied by the arrangement being a function of the number of lines providing pressure communication between the pressure source and the pistons.

In use, the actuating force applied to the tool by a selected actuating fluid pressure may be varied simply by changing the number of pistons in communication with the pressure source.

Preferably, each piston and cylinder defines a low pressure chamber, most preferably an atmospheric chamber.

The fluid lines may provide for pressure communication with well fluid, either in a tool bore or an annulus. Thus, the force applied to the tool by each piston will include an element provided by the hydrostatic fluid pressure. Of course, the deeper the tool is located in a bore the greater the hydrostatic pressure and the greater the pressure force. Thus, for actuating a tool which requires a predetermined actuating force, the number of pistons utilised will depend upon the depth of operation of the tool, that is the deeper the tool operates the fewer pistons that will be required.

These and other aspects of the present invention will now be described, by way of example, with reference to the accompanying drawings, in which.

Figure 5:
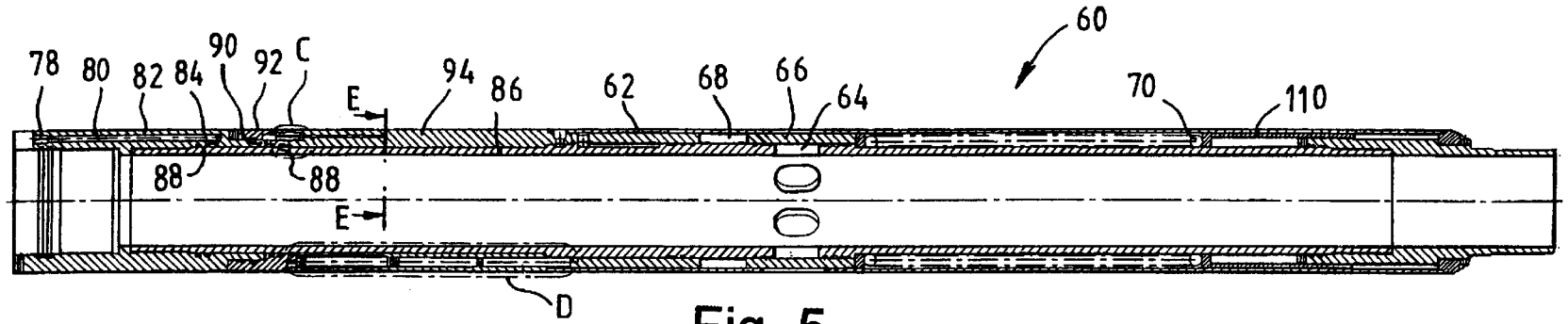
FIG. 5 is a sectional view of a valve in accordance with another embodiment of the present invention, showing the valve in the closed configuration.
Figure 6:
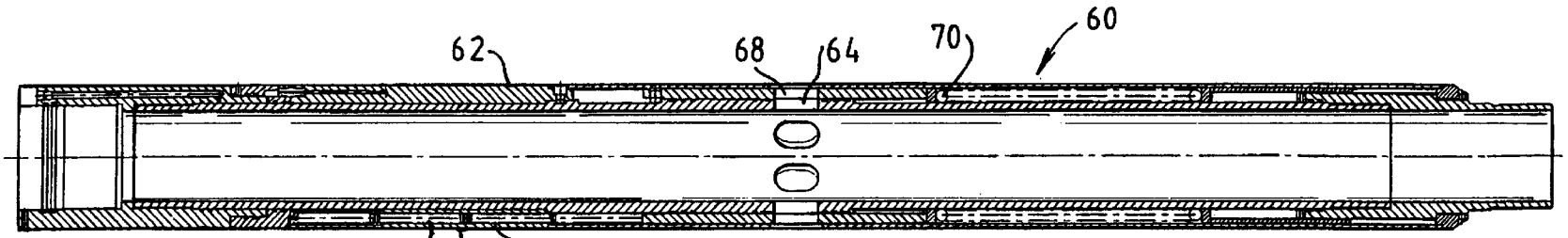
Figure 7:
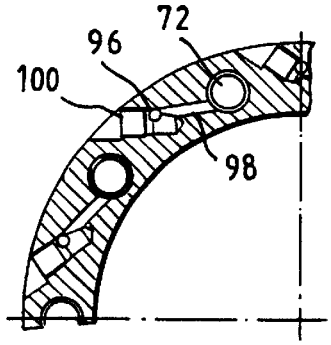
Figure 8:
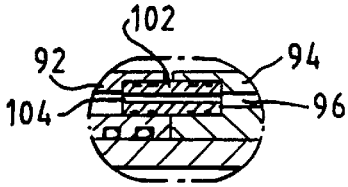

FIG. 6 corresponds to FIG. 5, but shows the valve in the open configuration;

FIG. 7 is an enlarged sectional view on line E—E of FIG. 5;

FIG. 8 is an enlarged view of area "C" of Fig. 5; and

Figure 4:
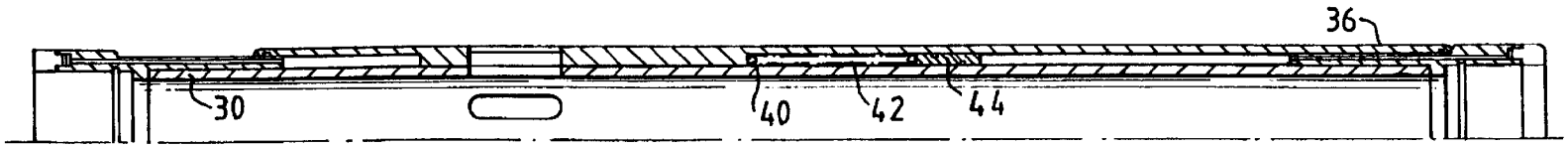
FIG. 4 is a half-sectional view of the valve of FIG. 2, showing the valve in the open configuration.
Figure 9:
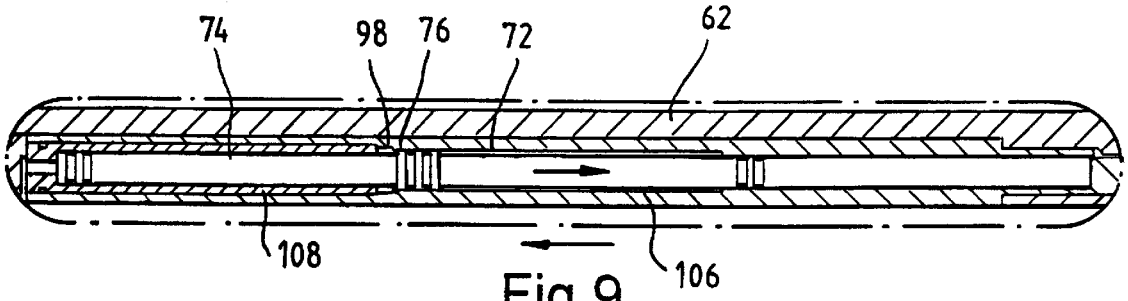

FIG. 9 is an enlarged view of area "D" of FIG. 4.

Figure 1:
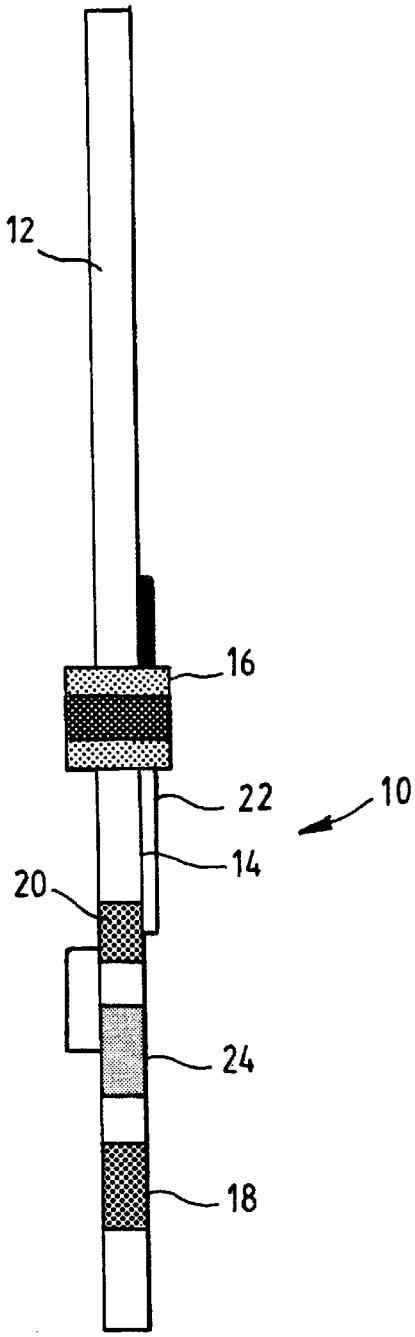
FIG. 1 is a schematic representation of apparatus in accordance with a preferred embodiment of the present invention.

Reference is first made to FIG. 1 of the drawings, which is a schematic illustration of a downhole apparatus 10 in accordance with a preferred embodiment of the present invention. The apparatus 10 is mounted on the lower end of a tubular string 12 and comprises a tubular body 14 mounted on the string, a packer 16 for providing a seal between the body 14 and the wall of the drilled bore in which the apparatus 10 is located in use, means for closing the bore of the body 14 in the form of a disc valve 18, such as disclosed in W097/28349, and a fluid actuated valve in the form of a sleeve valve 20 between the disc valve 18 and the packer 16, for permitting selective fluid communication between the body bore and the annulus surrounding the body. The valve 20 is operated by application of annulus pressure, and therefore a fluid line 22 extends from above the packer 16 to the valve 20. The operation of the valves 18, 20 are controlled by a tool 24 similar to that described in W097/06344, the operation of which will be described in greater detail below.

The valve 18 is initially closed and includes a disc which may be opened by application of tubing pressure, and under the control of the tool 24, to provide full bore communication between the body and string 14, 12 and the production zone of the bore. The control tool 24 includes circulation ports which are initially open, to allow the string body 12, 14 to fill with fluid as the apparatus 10 is run into the bore. The circulating ports may be closed by application of tubing pressure to the tool 24. Further pressure cycling configures the tool 24 to allow communication of tubing pressure to the valve 20 and to the packer 16, as will be described.

Figure 2:
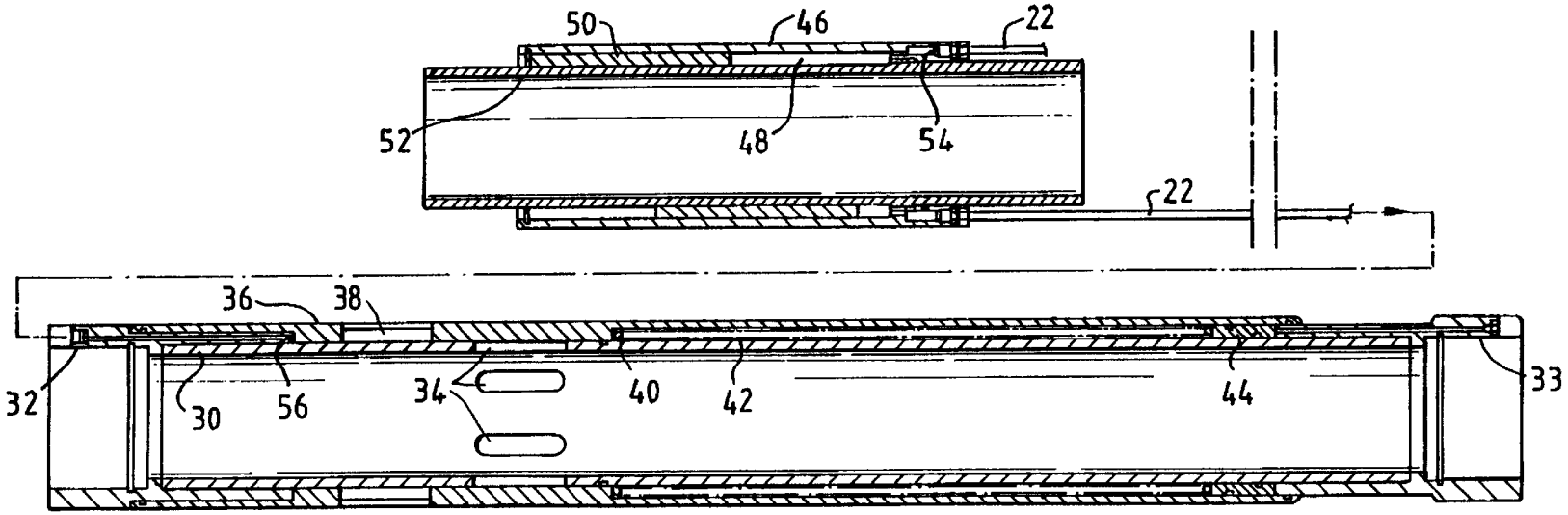
FIG. 2 is a sectional view of a valve of the apparatus of FIG. 1, showing the valve in the closed configuration.
Figure 3:
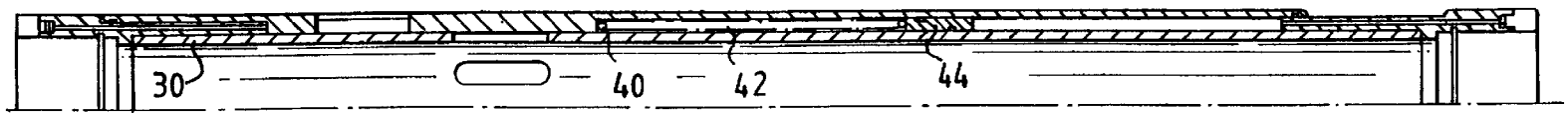
FIG. 3 is a half-sectional view of the valve of FIG. 2, showing a spring/nitrogen chamber of the valve after charging.

Reference is now also made to FIG. 2 of the drawings, which illustrates the valve 20 in greater detail. The valve 20 is "full bore" in that it does not create any significant restriction in the bore of the body 14. The valve 20 includes a body portion 30 including threaded end connectors 32, 33 for coupling to the adjacent parts of the body 14. The body portion 30 defines a plurality of circumferentially spaced ports 34 which are normally closed by an externally mounted sleeve 36. As will be described, the sleeve 36 is axially movable on the body portion 30 to bring ports 38 defined by the sleeve 36 into alignment with the body portion ports 34. The sleeve 36 is biased towards the closed position, as illustrated in FIG. 2, by a coil spring 40 and also by a gas spring provided by a compressible gas ($N_2$) contained within the spring chamber 42. Of course, the pressure experienced downhole will be considerably higher than that on surface, and to accommodate this the gas in the spring chamber 42 is compressed or "charged" to hydrostatic pressure when the apparatus is positioned downhole, as described below. A lower wall of the spring chamber 42 is formed by a axially movable piston collar 44. Under the control of the tool 24, the lower face of the collar 44 is exposed to tubing pressure, a control line extending from the valve 20 to a valve in the tool 24. The exposure of the collar 44 to hydrostatic tubing pressure causes the collar 44 to move upwardly and compress the gas within the chamber 42, until the gas pressure corresponds to hydrostatic pressure, as illustrated in FIG. 3 of the drawings. The upward movement of the collar into the chamber 42 is conserved by a ratchet arrangement between the collar 44 and the valve body portion 30.

Movement of the sleeve 36 to the open position, as illustrated in FIG. 4 of the drawings, is achieved by application of annulus pressure, above the set packer 16, which pressure is communicated to the sleeve as described below.

Mounted on the body 14 above the packer 16 is a hydraulic reservoir 46 which accommodates a fixed volume of hydraulic fluid 48 and a piston 50, an upper face of the piston being exposed to the annulus. The piston 50 is initially held in position by shear pins 52 and also a burst disc 54 which prevents flow of fluid 48 from the reservoir 46. However, on application of an overpressure, in this example 2000 psi, the pins 52 are sheared out and the burst disc 54 ruptures, to allow the piston 50 to move into the reservoir 46 and displace the fluid 48 through the fluid line 22 (as illustrated in the lower half of the relevant part of FIG. 2). The lower end of the fluid line 22 communicates with a piston face 56 defined by the sleeve 36, such that displacement of the hydraulic fluid 48 from the reservoir 46 causes the sleeve 36 to be pushed downwardly, as illustrated in FIG. 4, against the action of the spring 40 and the compressed gas held within the spring chamber 42, to align the ports 34, 38 and to allow flow of fluid into the body bore and then upwardly through the string 12.

In use, the apparatus 10 is made up to the string 12 on surface, and the control line 22 passing through the packer 16 is installed to connect the hydraulic reservoir 46 to the valve 20. The apparatus and the string 10, 12 are then run into the bore, with the control tool 24 configured to allow fluid to flow into the bore to fill the string 12. On reaching the desired depth, the tubing pressure is cycled to configure the control tool 24 to allow communication of tubing pressure to the lower face of the collar 44. The tubing pressure is then increased to 1500 psi to charge the gas in the spring chamber 42. Pressure is then bled off such that a control tool 24 again isolates the collar 44 from tubing pressure. Further, tubing pressure cycles are then applied to the control tool 24 to allow setting of the packer 16.

In order to test the packer 16, the annulus is pressurised to 1000 psi. Further increasing the annulus pressure to 2500 psi shears the pins 52 and ruptures the burst disc 54 and the piston 50 moves downwardly within the reservoir 46 causing the sleeve 36 to move to the open position. If pressure is then bled off from the annulus the sleeve 36 will return to the closed position.

Once the sleeve 36 has been closed, the pressure integrity of completion of the string 12 may be tested by pressuring the interior of the string 12 to 5000 psi.

Once testing has been completed, the sleeve 36 may be moved between the closed and opened positions as desired, by application of an operating pressure of 1500 psi to the annulus. There is no limit to the number of times that the sleeve may be cycled.

When it is desired to provide full bore access to the formation, tubing pressure may be applied to cycle the control tool 24 to allow opening of the valve 18.

Reference is now made to FIGS. 5 through 9 of the drawings, which illustrate a valve 60 in accordance with a further embodiment of the present invention. The valve 60 operates in a generally similar manner to the valve 20 described above, having a body portion 62 defining a plurality of circumferentially spaced ports 64 which are normally closed by a sleeve 66. As with the valve 20 described above, in the valve 60 the sleeve 66 is axially movable on the body portion 62 to bring ports 68 defined by the sleeve 66 into alignment with the body portion ports 64. The sleeve 66 is biased towards the closed position, as illustrated in FIG. 5, by a coil spring 70. The valve 60 does not utilise a gas spring, but does provide an arrangement for controlling the degree of actuating force applied to the sleeve 66 by virtue of hydrostatic pressure, as described below.

The body 62 defines ten circumferentially spaced cylinders 72, each of which contains a shuttle 74, the lower end of each shuttle 74 being in contact with the sleeve 66. Each shuttle 74 defines an annular piston 76 and the volume above the piston 76 is in communication with a hydraulic line (not shown) which allows transfer of pressure forces from above an adjacent packer, in a similar manner to the valve 20 described above.

The hydraulic line connects with a hydraulic inlet 78 in an upper end cap 80 of the body 62. An axial bore 82 extends through the cap 80, and a short cross bore 84 directs fluid into an annular area between an inner face of the cap 80 and an outer face of an inner sleeve 86. The area is isolated between seals 88 and a further cross bore 90 extends from the area into a distribution ring 92. Mounted below the ring 92 is a shuttle housing 94 which defines the cylinders 72 and a number of fluid communicating bores; each cylinder 72 is in communication with a respective axial bore 96 by means of a respective cross bore 98, as illustrated in FIG. 7 of the drawings. A plug 100 isolates each bore 98 from the annulus.

The upper end of each axial bore 96 communicates with the distribution ring 92 via a stab-in connector 102, one of which is shown enlarged in FIG. 8 of the drawings. The illustrated connector 102 defines a through bore 104, thus providing fluid communication between the ring 92 and the bore 96. However, "blind" connectors may also be provided, which prevent fluid communication between the ring 92 and bore 96.

Reference is now made in particular to FIG. 9 of the drawings, which illustrates a shuttle 74 in a cylinder 72. The cross bore 98 opens into the cylinder 72 above the piston 76. Below the piston 76, the cylinder 72 defines an atmospheric chamber 106. It will also be noted that the cylinder is sleeved 108 above the opening of the cross bore 98, such that the upper and lower ends of the shuttle 74, which in use are both exposed to annulus pressure, are of the same area.

In setting up a tool, an operator will first determine the hydrostatic fluid pressure at the operating depth of the valve 60. To this is added the "over pressure" which the operator wishes to apply to the annulus to open the valve 60. The rate of the spring 70 will be known, such that the force necessary to compress the spring and align the ports 64, 68 will be known. The operator may then determine the number of shuttles 74 which must be exposed to the over pressure to achieve this force.

Once the number of shuttles 74 has been determined, a corresponding number of connectors 102 are provided and are incorporated in the valve 60. The remaining shuttles 74 are isolated from the applied hydraulic pressure by fitting blind connectors.

In operation, the valve 60 is set up as described above, and run into a bore. In a similar manner to the valve 20 described above, the annulus fluid pressure above a packer is transmitted to the valve to actuate the appropriate number of shuttles 74, and thus move the sleeve 66 to align the ports 64, 68.

This arrangement allows the same tool to be utilised at a wide variety of operating depths by application of similar overpressures, simply by appropriate selection of connectors 102. Further adjustment may be provided by provision of spring preload adjustment rings 110 of different dimensions.

Those of skill in the art will realise that the embodiments as described above may be utilised in a number of applications, including drill stem tests and completions. In a drill stem test (DST), a temporary string is run into the bore and tests carried out on the formation. In many circumstances, once testing has been completed, the DST string will be removed and the bore temporarily capped, to await running in of a production string. However, with the apparatus as described above, testing may be carried out by utilising the valves 20, 60 as shut-in tools, and once testing is complete the tools may be closed and the string left in the bore. Conventionally, after the DST string has been removed, the bore is filled with brine or the like to prevent formation fluids flowing up through the bore. However, the brine may damage the hydrocarbon-bearing formation and make subsequent production from the formation difficult if not impossible. Using the apparatus as described above, the DST string may remain in the bore. When production from the bore is to commence, all that is required is that the valve 20, 60 be opened.

It will be clear to those of skill in the art that the above-described embodiments are merely exemplary of the present invention, and that various modifications and improvements may be made to the apparatus without departing from the scope of the invention.

What is claimed is:

1. Downhole apparatus for mounting on a string for location in a drilled hole, the apparatus comprising:

a tubular body defining a bore, the body adapted for location in larger diameter drilled hole such that there is an annulus defined between the body and the hole wall;

a packer mounted on said body for sealing the annulus between said body and the wall of the hole;

means for closing the body bore below said packer;

a fluid actuated valve in the body between said closing means and said packer, the valve being movable between a closed position and an open position for permitting selective fluid communication between the body bore and the exterior of the body, said tubular body being full bore when the valve is in the open position; and a means for transferring fluid pressure from above said packer to said valve, whereby fluid pressure applied to the annulus above said packer may be utilised to operate said valve.

2. Apparatus as claimed in claim 1, wherein the valve is normally closed.

3. Apparatus as claimed in claim 2, wherein the valve is biassed toward the closed position by fluid pressure.

4. Apparatus as claimed in claim 3, wherein a chamber is defined between said valve and said body for containing fluid for biassing the valve toward the closed position.

5. Apparatus as claimed in claim 4, wherein said chamber accommodates a spring.

6. Apparatus as claimed in claim 4, wherein said chamber is filled with pressurised fluid on surface to provide a desired spring force.

7. Apparatus as claimed in claim 4, wherein said chamber is filled with fluid to be pressurised at the operating depth of said apparatus.

8. Apparatus as claimed in claim 7, wherein said chamber is provided with a movable wall in fluid communication with at least one of a body bore and body exterior such that said wall experiences at least hydrostatic pressure, and said wall is adapted to pressurise fluid in said chamber to at least hydrostatic pressure.

9. Apparatus as claimed in claim 8, wherein said wall is adapted to be selectively exposed to at least one of the body bore and body exterior.

10. Apparatus as claimed in claim 2, wherein said valve is biassed toward the closed position by means of a spring biassing force.

11. Apparatus as claimed in claim 1, wherein the valve comprises a sleeve.

12. Apparatus as claimed in claim 11, wherein said sleeve is axially moveable relative to said body.

13. Apparatus as claimed in claim 12, wherein said sleeve defines at least one port which is selectively alignable with a corresponding port in said body.

14. Apparatus as claimed in claim 11, wherein said sleeve is mounted externally of said body.

15. Apparatus for mounting below a packer on a downhole tubing string, the apparatus comprising a tubular body for location in larger diameter drilled hole such that there is an annulus defined between the body and the hole wall and the body defining an internal bore and including a valve which is movable between a closed position and an open position for providing selective fluid communication between said bore and the annulus, said valve being fluid actuated and adapted for communication with means for transferring fluid pressure from above a packer to said valve, whereby fluid pressure applied to the annulus above the packer may be utilised to operate said valve and wherein said tubular body is full bore when the valve is in the open position.

16. An apparatus as claimed in claim 15, further comprising a means for transferring fluid pressure from above a packer to said valve, said means including a piston having one face for communication with fluid above said packer and the other face in communication with a volume of fluid in a fluid line.

17. An apparatus as claimed in claim 16 wherein said volume of fluid communicates with a piston face defined by said valve in said fluid line.

18. Downhole apparatus for mounting on a string for location in a drilled hole, the apparatus comprising:

a tubular body defining a bore, the body adapted for location in a larger diameter drilled hole such that there is an annulus defined between the body and the hole wall;

a packer mounted on said body for sealing the annulus between said body and the wall of the hole; and means for closing the body bore below said packer, said means comprising:

a fluid actuated valve including a sleeve mounted externally of said body between said closing means and said packer for permitting selective fluid communication between the body bore and an exterior of the body; and means for transferring fluid pressure from above said packer to said valve sleeve, whereby fluid pressure applied to the annulus above said packer actuates said valve sleeve.

19. Downhole apparatus for mounting on a string for location in a drilled hole, the apparatus comprising:

a tubular body defining a bore, the body adapted for location in a larger diameter drilled hole such that there is an annulus defined between the body and the hole wall;

a packer mounted on said body for sealing the annulus between said body and the wall of the hole; and means for closing the body bore below said packer, said means comprising:

a fluid actuated valve disposed in the body between said closing means and said packer for permitting selective fluid communication between the body bore and an exterior of the body, said valve being biassed toward a closed position by fluid pressure and being normally closed; and means for transferring fluid pressure from above said packer to said valve, whereby fluid pressure applied to the annulus above said packer actuates said valve.

20. Apparatus as claimed in claim 19, further comprising a chamber defined between said valve and said body for containing fluid for biassing the valve toward the closed position.

21. Apparatus as claimed in claim 20, further comprising a spring disposed in said chamber.

22. Apparatus as claimed in claim 20, wherein said chamber is filled with pressurised fluid on surface to provide a desired spring force.

23. Downhole apparatus for mounting on a string for location in a drilled hole, the apparatus comprising:

a tubular body defining a bore, the body adapted for location in a larger diameter drilled hole such that there is an annulus defined between the body and the hole wall;

a packer mounted on said body for sealing the annulus between said body and the wall of the hole; and means for closing the body bore below said packer, said means comprising:

a fluid actuated valve disposed in the body between said closing means and said packer for permitting selective fluid communication between the body bore and an exterior of the body, said valve being biassed toward a closed position by means of a spring biassing force and being normally closed; and a means for transferring fluid pressure from above said packer to said valve, whereby fluid pressure applied to the annulus above said packer operates said valve.

24. Downhole apparatus for mounting on a string for location in a drilled hole, the apparatus comprising:

a tubular body defining a bore, the body adapted for location in a larger diameter drilled hole such that there is an annulus defined between the body and the hole wall;

a packer mounted on said body for sealing the annulus between said body and the wall of the hole; and means for closing the body bore below said packer, said means comprising:

a fluid actuated valve disposed in the body between said closing means and said packer for permitting selective fluid communication between the body bore and an exterior of the body; and means for transferring fluid pressure from above said packer to said valve, whereby fluid pressure applied to the annulus above said packer may be utilized to operate said valve, said fluid pressure transferring means comprising:

a chamber defined between said valve and said body for containing fluid to be pressurised at the operating depth of said apparatus, said chamber being provided with a moveable wall in fluid communication with at least one of said body bore and said body exterior such that said wall experiences at least hydrostatic pressure, said wall being adapted to be selectively exposed to at least one of the body bore and the body exterior so as to pressurise fluid in said chamber to at least hydrostatic pressure, such that the valve is biased toward a closed position by fluid pressure and is normally closed.

* * * * *